US008822376B2

(12) United States Patent
Kawakami

(10) Patent No.: US 8,822,376 B2
(45) Date of Patent: Sep. 2, 2014

(54) THERMAL TRANSFER SHEET

(75) Inventor: Teruki Kawakami, Kanagawa (JP)

(73) Assignee: Sony Corporation, Tokyo (JP)

( * ) Notice: Subject to any disclaimer, the term of this patent is extended or adjusted under 35 U.S.C. 154(b) by 87 days.

(21) Appl. No.: 13/616,136

(22) Filed: Sep. 14, 2012

(65) Prior Publication Data

US 2013/0078396 A1 Mar. 28, 2013

(30) Foreign Application Priority Data

Sep. 22, 2011 (JP) ..... 2011-208137

(51) Int. Cl.
*B41M 5/52* (2006.01)

(52) U.S. Cl.
CPC ..... *B41M 5/5254* (2013.01); *B41M 5/5272* (2013.01); *B41M 2205/02* (2013.01); *B41M 2205/32* (2013.01)
USPC ..... 503/227

(58) Field of Classification Search
CPC .... B41M 5/52; B41M 5/5263; B41M 5/5272; B41M 5/5254; B41M 2205/02; B41M 2205/32
USPC ..... 503/227; 8/471
See application file for complete search history.

(56) References Cited

FOREIGN PATENT DOCUMENTS

| | | |
|---|---|---|
| EP | 0 728 592 | 8/1996 |
| EP | 1 026 001 | 8/2000 |
| JP | 63-319188 | 12/1988 |
| JP | 4-101891 | 4/1992 |
| WO | WO 2006/057192 | 6/2006 |

OTHER PUBLICATIONS

Search Report issued in corresponding European application No. 12181168.1 dated Feb. 10, 2014.

*Primary Examiner* — Bruce H Hess
(74) *Attorney, Agent, or Firm* — Frommer Lawrence & Haug LLP; William S. Frommer

(57) ABSTRACT

There is provided a thermal transfer sheet including a base sheet, and a dye receiving layer formed on the base sheet and containing a mixture of copolymer A including styrene and acrylonitrile as monomers and a copolymer B including 2-phenoxyethyl methacrylate and 2-hydroxyethyl methacrylate as monomers.

6 Claims, 1 Drawing Sheet

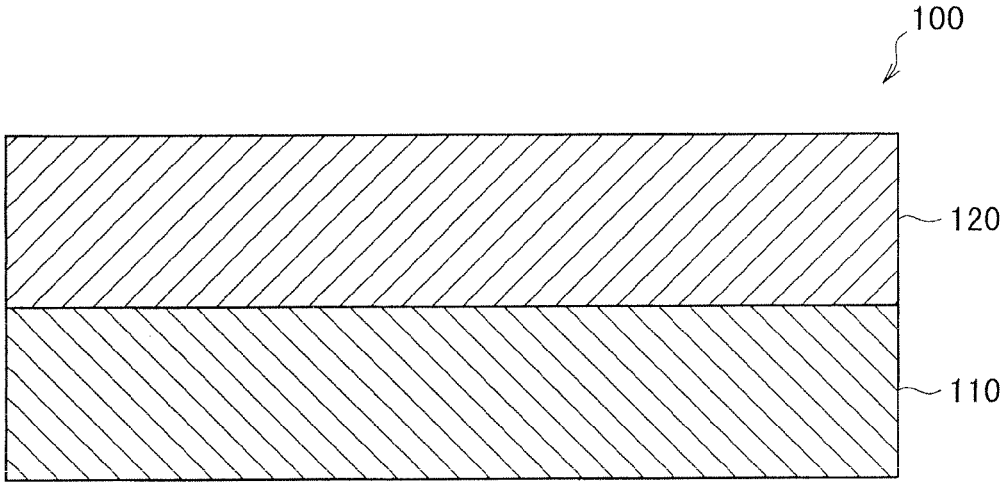
100
120
110

THERMAL TRANSFER SHEET

BACKGROUND

The present disclosure relates to a thermal transfer sheet onto which a dye is thermally transferred.

A thermal transfer method using a sublimation dye includes transferring a number of color dots to a thermal transfer material by heating within a very short period of time and reproducing a full-color image using various color dots. In such a thermal transfer method, an image or a character is formed by closely adhering a dye layer of a thermally transferring sheet to a thermal transfer sheet, heating the thermally transferring sheet from a reverse side of the dye layer using heating means such as a thermal head according to an image signal, and transferring a dye included in the dye layer to the thermal transfer sheet. In this case, a sheet having a dye receiving layer formed therein to receive a dye transferred from the thermally transferring sheet on a surface of a sheet-shaped base material is used as the thermal transfer sheet. According to the thermal transfer method using such a sublimation dye, a high-definition and high-density recorded matter is obtained.

In recent years, as digital cameras have come into wide use, there is an increasing demand for a thermal transfer method by which such a high-definition and high-density recorded matter can be obtained. Furthermore, there is a demand for obtaining an image having high sensitivity and excellent light fastness.

As technology satisfying the above-mentioned requirements, for example, International Publication No. WO7006/057192 discloses a thermal transfer sheet including a dye receiving layer containing a graft polymer of polyester and at least one monomer selected from an acrylic monomer and a methacrylic monomer. The characteristics of the dye receiving layer include high sensitivity and excellent light fastness.

In the technology of International Publication No. WO2006/057192, however, it is necessary for the dye receiving layer to further include an isocyanate-based curing agent in an aspect of securing heat resistance (blocking resistance). For this reason, a dye receiving layer is formed in a process of manufacturing a thermal transfer sheet by coating a base sheet such as a printing paper with a solution obtained by dissolving a resin and a curing agent in solvent as a dye receiving layer and drying the coated solution. In this case, it is necessary to install separate equipment so as to re-collect and store an evaporated solvent. Also, humidity-curing polyisocyanate is generally used as a curing agent that is added to strengthen the film strength of a dye receiving layer. When the humidity-curing curing agent is used, a solution for forming a dye receiving layer is coated and dried, and a resin is cured under the environment of uniform temperature and humidity. As a result, it may also be necessary to separately add an aging process or equipment used in the aging process. For the above-described reasons, when the curing agent is used to form the dye receiving layer as described in International Publication No. WO2006/057192, a manufacturing process is complicated, and equipment is large and specialized. As a result, the productivity is lowered, thereby resulting in an increase in manufacturing costs.

Meanwhile, for example, Japanese Patent Laid-Open Publication No. H04-101891 discloses a thermal dye transfer receiving element obtained by a method by which a resin coating layer is pressed onto a paper support. In this method, a solution for a dye transfer receiving layer is not coated onto a base as described above, but a thermoplastic resin is softened with heat and elongated using a nip roller to be laminated as a dye receiving layer on a base sheet such as a printing paper. For this reason, the method of Japanese Patent Laid-Open Publication No. H04-101891 is inexpensive compared with a coating method because a manufacturing process is simple and there is less necessity for large-scale and specialized manufacturing equipment.

Also, Japanese Patent Laid-Open Publication No. S63-319188 discloses a sublimable image-receiving material for thermal transfer recording using a copolymer resin (hereinafter also referred to as an "AS resin") which is formed using acrylonitrile and styrene as essential ingredients, which are materials applicable to the technology described in Japanese Patent Laid-Open Publication No. H04-101891.

SUMMARY

However, when a thermoplastic resin used in Japanese Patent Laid-Open Publication No. H04-101891 or an AS resin used in Japanese Patent Laid-Open Publication No. S63-319188 is used, a color reproduction characteristic is degraded due to poor sensitivity. Also, light fastness (preservability) is lowered, and spreading easily occurs.

As described above, a thermal transfer sheet in which performance such as high sensitivity, light fastness and spreading resistance is compatible with performance such as productivity, inexpensiveness and blocking resistance has not been obtained so far.

Therefore, there is a demand for a thermal transfer sheet, on which an image having high sensitivity, excellent light fastness, low spreading and excellent blocking resistance can be formed, which can be manufactured at a low cost using a simple process.

According to an embodiment of the present disclosure, there is provided a thermal transfer sheet which includes a base sheet, and a dye receiving layer formed on the base sheet and containing a mixture of copolymer A including styrene and acrylonitrile as monomers and copolymer B including 2-phenoxyethyl methacrylate and 2-hydroxyethyl methacrylate as monomers.

According to the embodiments of the present disclosure described above, when a dye receiving layer obtained using copolymer A (AS resin) having excellent blocking resistance includes copolymer B (an acrylic resin composed of certain monomers), a glass transition temperature of a resin may be lowered, and thus the resin may be softened. Therefore, since the sensitivity of the dye receiving layer is improved and the dye is sufficiently diffused into the dye receiving layer, the light fastness of the image is improved. Also, according to the present disclosure, since the dye receiving layer includes the copolymer A, the use of the curing agent is unnecessary, which makes it possible to manufacture a thermal transfer sheet at a low cost using a simple process.

As described above, according to the present disclosure, it is possible to manufacture a thermal transfer sheet, on which an image having high sensitivity, excellent light fastness, low spreading and excellent blocking resistance can be formed, at a low cost using a simple process.

BRIEF DESCRIPTION OF THE DRAWINGS

FIG. 1 is a schematic cross-sectional view showing a configuration of a thermal transfer sheet according to a preferred embodiment of the present disclosure.

DETAILED DESCRIPTION OF THE EMBODIMENTS

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

Description will be in the following order.

1. Configuration of Thermal Transfer Sheet
1.1. Overall Configuration
1.2. Base Sheet
1.3. Dye Receiving Layer
2. Method of Manufacturing Thermal Transfer Sheet
2.1. Preparation of AS Resin
2.2. Synthesis of Acrylic Resin
2.3. Preparation of Mixed Solution
2.4. Coating and Drying of Mixed Solution

[1. Configuration of Thermal Transfer Sheet]

[1.1. Overall Configuration]

Referring to FIG. 1, first, the overall configuration of a thermal transfer sheet according to a preferred embodiment of the present disclosure will be described. FIG. 1 is a schematic cross-sectional view showing a configuration of a thermal transfer sheet according to a preferred embodiment of the present disclosure.

As shown in FIG. 1, the thermal transfer sheet 100 according to the present embodiment includes a base sheet 110 and a dye receiving layer 120 formed on the base sheet 110.

In general, the dye receiving layer is formed using a polymer resin as a main component. A curing agent such as polyisocyanate may be added to the dye receiving layer so as to improve heat resistance. The thermal transfer sheet including the dye receiving layer to which the curing agent is added has problems in that preservability with respect to light, that is, light fastness, may not be sufficient and degradation of a degree of definition or discoloration of an image may occur with time. These problems are considered to be caused because the majority of the dye delivered from a thermally transferring sheet to the thermal transfer sheet falls in the vicinity of a surface of the dye receiving layer, and the dye falling on the surface is affected by light. In a recording device using a thermal transfer method, diffusion of the dye into the dye receiving layer also tends to be inhibited when high-speed recording is performed. Therefore, when the dye falls in the vicinity of the surface of the dye receiving layer, the probability of degrading light fastness is increased. Accordingly, the image may be degraded in such a thermal transfer sheet because the light fastness is poor and the image is deteriorated in degree of definition or discolored by light.

Therefore, in a thermal transfer sheet 100 as will described later in detail, a thermal transfer dye layer 120 includes a mixture of copolymer A including styrene and acrylonitrile as monomers (hereinafter referred to as an "AS resin") and copolymer B including 2-phenoxyethyl methacrylate and 2-hydroxyethyl methacrylate as monomers (hereinafter referred to as an "acrylic resin"), as polymer resins.

[1.2. Base Sheet 110]

A base sheet 110 functions to support the dye receiving layer 120. More particularly, the base sheet 110 is formed of, for example, a plastic film such as polyethylene terephthalate (PET), polypropylene (PP) or polyethylene (PE) or a paper such as synthetic paper, coated paper, art paper, cast-coated paper or wood-free paper. Also, the plastic film or the paper may be used alone as the base sheet 110, or a combination of the plastic film and the paper may also be used. The base sheet 110 has sufficient heat resistance to withstand heat of a thermal head when a dye is transferred to the dye receiving layer 120, and also shows sufficient hardness to not be broken during handling.

In addition, a back layer (not shown) may be formed on a surface opposite to a surface of the base sheet 110 on which the dye receiving layer 120 is laminated. The back layer is a layer configured to control a coefficient of friction between the thermal transfer sheet 100 and a conveyance mechanism of the recording device so that the thermal transfer sheet 100 can be stably conveyed inside the recording device operating in a thermal transfer mode.

[1.3. Dye Receiving Layer 120]

The dye receiving layer 120 is a layer receiving a transferred dye obtained when a desired dye is selectively transferred from a dye layer which is formed on a thermally transferring sheet (not shown) and contains, for example, yellow, magenta and cyan sublimable dyes. Also, the image formed by the dye received from the thermally transferring sheet is maintained in the dye receiving layer 120 for a long time. To realize the above-described functions, the dye receiving layer 120 is formed of a resin that can be dyed by the transferred dye, and, in the present embodiment, formed of a mixture of an AS resin and an acrylic resin.

Here, in the present embodiment, the reason for which the mixture of the AS resin and the acrylic resin is used as the resin forming the dye receiving layer 120 will be described in further detail. As described above, when the AS resin is used for the dye receiving layer 120, the dye receiving layer 120 may be prepared without adding a curing agent. As a result, although the use of the AS resin has a merit of saving costs, it is not good in terms of sensitivity or light fastness. Therefore, a mixture obtained by mixing an acrylic resin including 2-phenoxyethyl methacrylate (hereinafter referred to as "PEMA") and 2-hydroxyethyl methacrylate (hereinafter referred to as "HEMA") as monomers with the dye receiving layer 120 using the AS resin is used in the thermal transfer sheet 100. Therefore, a glass transition temperature of a resin may be lowered, and thus the resin may be softened. As a result, light fastness of the image may be improved because sensitivity of the dye receiving layer 120 is improved, and the dye is sufficiently diffused into the dye receiving layer 120.

Also, the acrylonitrile used as the monomer of the AS resin does not show toxicity when the acrylonitrile is polymerized into a resin. However, when the acrylonitrile is present as a monomer, the acrylonitrile shows very high toxicity, and thus it is necessary to provide exclusive equipment to handle the acrylonitrile monomer in manufacture of the thermal transfer sheet 100. For this reason, when the dye receiving layer 120 is formed in the present embodiment, synthesis of a copolymer including an acrylonitrile monomer, a styrene monomer, a PEMA monomer and a HEMA monomer is also accompanied with danger. On the other hand, the use of the AS resin has a merit such as high stability in the present embodiment since the AS resin is used in a resinified state and an acrylic resin is mixed with the AS resin.

In addition, the dye receiving layer 120 preferably has a thickness of 1 μm to 10 μm, and more preferably 2 μm to 8 μm. When the thickness of the dye receiving layer 120 is less than 1 μm, the dye receiving layer 120 may be easily affected by a base and image qualities may be unstable due to thickness instability. On the other hand, when the thickness of the dye receiving layer 120 exceeds 10 μm, transfer sensitivity may be deteriorated, and thus printing density may be lowered.

(AS Resin)

Since the AS resin used in the dye receiving layer 120 shows excellent heat resistance (blocking resistance), the AS resin is a resin that is essentially used to make the use of a curing agent unnecessary. That is, when the AS resin is used to form the dye receiving layer 120, a process of curing a resin by separately adding a curing agent is made unnecessary for formation of the dye receiving layer 120. Therefore, a manufacturing process of the thermal transfer sheet 100 is simple, and there is less necessity for large-scale and specialized manufacturing equipment, thereby saving the costs.

A molar ratio of the styrene to the acrylonitrile used as the monomers of the AS resin is preferably in a range of 70:30 to 80:20. When the molar ratio of the acrylonitrile exceeds 30, the resin may be darkened, which spoils the beauty of a product of the thermal transfer sheet 100. On the other hand, when the molar ratio of the acrylonitrile is less than 20, sensitivity of the dye receiving layer 120 may be reduced.

(Acrylic Resin)

Since the acrylic resin used in the dye receiving layer 120 shows excellent sensitivity to a dye and light fastness, the acrylic resin is a resin that is necessarily used to improve the sensitivity and light fastness by being mixed with the AS resin. That is, using the acrylic resin mixed with the AS resin in the dye receiving layer 120 being used, the sensitivity or light fastness may be further improved in a state in which it is unnecessary to use a curing agent because the blocking resistance is maintained.

An effect of mixing of the acrylic resin on improvement of the sensitivity or light fastness is affected by a ratio of PEMA to HEMA used as the monomers of the acrylic resin. Therefore, a molar ratio of PEMA to HEMA in the acrylic resin used in the dye receiving layer 120 is preferably in a range of 80:20 to 95:5, and more preferably 85:15 to 95:5. When the molar ratio of HEMA exceeds 20, sensitivity and light fastness of the dye receiving layer 120 may be reduced. On the other hand, when the molar ratio of HEMA is less than 5, sensitivity of the dye receiving layer 120 may be reduced.

(Mixing Ratio of AS Resin to Acrylic Resin)

As described above, mixing the acrylic resin with the AS resin enables sensitivity and light fastness to be further improved in a state in which it is unnecessary to use a curing agent since blocking resistance of the AS resin is maintained. Therefore, the acrylic resin is preferably included to an extent to which the acrylic resin does not cause damage to the blocking resistance of the AS resin. More particularly, a mixing ratio of the AS resin to the acrylic resin is preferably in a range of 50:50 to 90:10, and more preferably 50:50 to 80:20 (based on the mass ratio). When the mixing ratio of the acrylic resin exceeds 50, the resin in the dye receiving layer 120 is excessively softened, and heat resistance may be reduced, which can easily lead to blocking or spreading of an image. On the other hand, when the mixing ratio of the acrylic resin is less than 10, the dye receiving layer 120 may not have sufficient sensitivity, or light fastness of the image may be reduced.

(Polyester Polyol)

Also, the dye receiving layer 120 preferably further includes a polyester polyol so as to further improve the sensitivity to a dye. The polyester polyol is a resin that is a dehydration condensation product of an aliphatic or aromatic diol and an aliphatic or aromatic dicarboxylic acid, and contains hydroxyl groups at both ends thereof.

The aliphatic diol may, for example, include ethylenediol, propylenediol, butanediol, pentanediol and hexanediol. The aromatic diol may, for example, include bisphenols such as bisphenol A.

In addition, the aliphatic dicarboxylic acid may, for example, include succinic acid, adipic acid, sebacic acid and fumaric acid. The aromatic carboxylic acid may, for example, include phthalic acid, isophthalic acid and terephthalic acid.

Among these polyester polyols, a dehydration condensation product of the aliphatic diol and aliphatic dicarboxylic acid is preferred, and a dehydration condensation product of hexanediol and adipic acid is more preferred in an aspect of further enhancing an effect of improving the sensitivity.

Additionally, a content of the polyester polyol is preferably in a range of 5 parts by mass to 20 parts by mass, more preferably 10 parts by mass to 20 parts by mass, and further preferably 10 parts by mass to 15 parts by mass, based on 100 parts by mass of the mixture of the AS resin and the acrylic resin. When the content of the polyester polyol exceeds 20 parts by mass, the image may be easily spread. On the other hand, when the content of the polyester polyol is less than 5 parts by mass, the resin is not sufficiently plasticized, and thus an effect of improving the sensitivity may not be sufficiently realized.

(Other Additives)

To improve a degree of whiteness, the above-described dye receiving layer 120 may further include an inorganic pigment such as titanium oxide, calcium carbonate or zinc oxide, or a fluorescent whitening agent.

Also, the dye receiving layer 120 may further include a release agent. For example, a silicon oil such as a methyl styrene-modified silicon oil, an olefin-modified silicon oil, a polyether-modified silicon oil, a fluorine-modified silicon oil, an epoxy-modified silicon oil, a carboxyl-modified silicon oil or an amino-modified silicon oil, or a fluorine-based release agent may be used as the release agent.

The dye receiving layer 120 may include an antistatic agent so as to prevent static electricity from being generated during conveyance inside the recording device operating in a thermal transfer mode, or a surface of the dye receiving layer 120 may be coated. For example, various surfactants such as a cationic surfactant (a quaternary ammonium salt, a polyamine derivative, etc.), an anionic surfactant (alkylbenzene sulfonate, alkyl sulfuric acid ester sodium salt, etc.) and a zwitterionic surfactant or non-ionic surfactant may be used as the antistatic agent.

Also, the dye receiving layer 120 may include a plasticizer, as necessary. For example, phthalic acid ester, adipic acid ester, trimellitic acid ester, pyromellitic acid ester or polyhydric phenol ester may be uses as the plasticizer. In addition to the above-described components, the dye receiving layer 120 may optionally include an ultraviolet ray (UV) absorbing agent or an antioxidant so as to improve preservability. For example, a benzophenone-based, diphenylacrylate-based or benzotriazole-based UV absorbing agent may be used as the UV absorbing agent. For example, a phenol-based, organic sulfur-based, phosphite-based or phosphoric acid-based antioxidant may be used as the antioxidant.

[2. Method of Manufacturing Thermal Transfer Sheet]

Although the configuration of the thermal transfer sheet 100 according to the present embodiment has been described in detail, a method of manufacturing the thermal transfer sheet 100 having the above-described configuration will be described in detail.

[2.1. Preparation of AS Resin]

As described above, a product commercially available as the polymerized copolymer of acrylonitrile and styrene may be used as the AS resin. A commercially available product of the AS resin includes "AS-30," "AS-41," "AS-61" and "AS-70" commercially available from Nippon Steel Chemical Carbon Co., Ltd.

[2.2. Synthesis of Acrylic Resin]

A copolymer of PEMA and HEMA obtained by polymerizing PEMA and HEMA at a predetermined ratio (preferably at the above-described ratio) may be used as the acrylic resin. In this case, a method of polymerizing PEMA and HEMA may, for example, include any known polymerization methods such as suspension polymerization, solution polymerization, emulsion polymerization and bulk polymerization, but the present disclosure is not limited thereto. Among the polymerization methods, the polymerization method may be performed using the solution polymerization so as to facilitate polymerization.

Also, commercially available products may be used as the PEMA and HEMA.

[2.3. Preparation of Mixed Solution]

Next, the AS resin and acrylic resin prepared and synthesized as described above are mixed in an organic solvent to form a mixed solution for forming a dye receiving layer 120. In this case, the above-described polyester polyol or other additives may be added to the mixed solution, as necessary.

The polyester polyol may be synthesized through a dehydration condensation reaction of diol and dicarboxylic acid, but a product commercially available as the polyester polyol may also be used. For example, such a commercially available product includes "HS2H-201A," "HS2H-451A," "HS2F-431A," "HS2E-581A," and "HS2H-350S" commercially available from Hokoku Corporation.

Also, a solid concentration of the mixed solution is preferably in a range of 20% by mass to 30% by mass so that the mixed solution can reach a viscosity at which it is easy to handle during coating. In addition, 2-butanone, a mixed solution of 2-butanone and toluene, and a mixed solution of 2-butanone and ethyl acetate may be used as the organic solvent used as the solvent in the mixed solution, but the present disclosure is not limited thereto.

[2.4. Coating and Drying of Mixed Solution]

The mixed solution prepared as described above is coated onto a base sheet 110, and dried to obtain a thermal transfer sheet 100 in which a dye receiving layer 120 is formed on the base sheet 110 without undergoing a process of resin curing.

A method of coating the mixed solution is not particularly limited. For example, a known method such as a gravure coating may be used.

Also, a drying condition is preferably determined so that a film thickness after drying of the dye receiving layer 120 is preferably in a range of 1 μm to 10 μm, and more preferably 2 μm to 8 μm. As the specific drying condition, for example, the drying is preferably carried out at approximately 90° C. to 120° C.

EXAMPLES

Hereinafter, the present disclosure will be described in further detail with reference to Examples, but the following Examples are not designed to limit the scope of the present disclosure.

[Method of Manufacturing Thermal Transfer Sheet]

First, a method of manufacturing a thermal transfer sheet used in each of Examples and Comparative Examples will be described.

Example 1

Based on the ratios listed in the following Table 1, AS-61 (a copolymer of styrene monomer and acrylonitrile monomer at a mixing ratio of 24:76) commercially available from Nippon Steel Chemical Co., Ltd. was used as the AS resin, and a PEMA/HEMA copolymer was used as the acrylic resin. Then, the AS resin and the acrylic resin were mixed. Subsequently, a mixed solution for forming a dye receiving layer, which was obtained by diluting the mixture with a mixed solvent of 2-butanone and toluene (mixing ratio of 1:1) so that a solid content of the mixture could be 20% by mass, was coated onto 150 μm of synthetic paper ("YUPO FPG-150" commercially available from Oji Yuka) so that a thickness after drying of the mixed solution could amount to 3 μm, and dried at 120° C. for 1 minute to remove a solvent, thereby manufacturing a thermal transfer sheet of Example 1.

Examples 2 to 6 and Comparative Examples 1 to 5

Thermal transfer sheets of Examples 2 to 12 and Comparative Examples 1 to 5 were manufactured in the same manner as described in Example 1, except that a content of the AS resin, a content of the acrylic resin, a mixing ratio of PEMA to HEMA, kinds of the monomers of the acrylic resin, and a content of the polyester polyol were changed as listed in Table 1.

[Printing Method Using Thermal Transfer Sheet]

Printing was carried out on the thermal transfer sheets of Examples 1 to 12 and Comparative Examples 1 to 6 manufactured as described above using a thermal transfer printer (UP-DR200 printer commercially available from Sony Corp.) and an ink ribbon (UPC-204 commercially available from Sony Corp.) containing yellow (Y), magenta (M), and cyan (C) dyes and having a laminated film (L) formed therein.

[Evaluation Method of Thermal Transfer Sheet]

After the printing, each of the thermal transfer sheets was evaluated for sensitivity, light fastness, spreading when kept under conditions of high temperature, and blocking resistance when kept under conditions of high temperature with a surface of the thermal transfer sheet having the dye receiving layer juxtaposed with the surface of a back layer. Specific evaluation methods were as follows.

(Evaluation of Sensitivity)

A maximum printing density was used as an indicator of sensitivity. More particularly, grey level printing was carried out on each of the thermal transfer sheets using the thermal transfer printer and the ink ribbon, and the maximum printing density was measured using a Macbeth reflection densitometer (TR-924). Then, the sensitivity was evaluated, as follows.

A: A maximum printing density is 2.20 or more

B: A maximum printing density is 2.10 or more and less than 2.20

C: A maximum printing density is 2.00 or more and less than 2.10

D: A maximum printing density is 1.80 or more and less than 2.00

E: A maximum printing density is less than 1.80

It was confirmed that the thermal transfer sheets that had a maximum printing density of 1.80 or more and were rated as Grades A to D showed a good dying property since the dye was developed with a predetermined concentration. Meanwhile, it was confirmed that the thermal transfer sheets that had a maximum printing density of less than 1.80 and were rated as Grade E showed a poor dying property since the dye was not developed with a predetermined concentration.

(Evaluation of Light Fastness)

For evaluation of light fastness, grey level printing was carried out on each of the thermal transfer sheets using the same thermal transfer printer and ink ribbon as described above, and the density was measured using a Macbeth reflection densitometer (TR-924). A measured value of the density is referred to as OD0. Also, an image was irradiated with xenon light using a Xenon Long-life Weatherometer (Suga Test Instruments Co., Ltd.), and the density was measured again using the Macbeth reflection densitometer. A measured value of the density after irradiation with xenon light is referred to as OD1. A fading rate was calculated from the density (OD0) before irradiation with xenon light and the density (OD1) after irradiation with xenon light, and the light fastness was then evaluated, as follows. The equation is as follows: Fading rate (%)={(OD0−OD1)/OD0}×100.

A: A fading rate is 5% or less

B: A fading rate is 7.5% or less and greater than 5%

C: A fading rate is 10% or less and greater than 7.5%

D: A fading rate is greater than 10%

It was confirmed that the fading was inhibited in the case of the thermal transfer sheets that had a fading rate of 10% or less and were rated as Grades A to C. On the other hand, it was confirmed that the fading was not inhibited in the case of the thermal transfer sheets that had a fading rate of greater than 10% and were rated as Grade D.

(Evaluation of Spreading)

For evaluation of spreading, lines having a width of approximately 1 mm were printed on each of the thermal transfer sheets using the same thermal transfer printer and ink ribbon as described above, and a width of an image was measured. A measured value of the width is referred to as L0. Then, the image was kept for 1 month under conditions of 60° C. and 85% relative humidity. After being kept, a width of the image was measured, and a measured value of the width is referred to as L1. A spreading rate (%) was calculated according to the following equation, and the spreading was evaluated as follows. The equation is as follows: Spreading rate (%)={(L1−L0)/L0}×100.

A: A spreading rate is 5% or less

B: A spreading rate is 10% or less and greater than 5%

C: A spreading rate is 15% or less and greater than 10%

D: A spreading rate is 25% or less and greater than 15%

E: A spreading rate is greater than 25%

It was confirmed that the spreading was inhibited under the conditions of high temperature and humidity in the case of the thermal transfer sheets that had a spreading rate of 15% or less and were rated as Grades A to C. On the other hand, it was confirmed that the spreading was not inhibited under the conditions of high temperature and humidity in the case of the thermal transfer sheets that had a spreading rate of greater than 15% and were rated as Grades D and E.

(Evaluation of Blocking Resistance)

For evaluation of blocking resistance, the surface of each of the thermal transfer sheets having the dye receiving layer was juxtaposed with a surface of a back layer of another thermal transfer sheet (UPC-204 commercially available from Sony Corp.), and a load of 0.06 kg/cm$^2$ was applied to each of the thermal transfer sheets. Then, the thermal transfer sheets were kept at 45° C. for 2 days, and surface roughness of the dye receiving layer was observed. The blocking resistance was evaluated, as follows.

A: A surface is not rough at all

B: A surface is slightly rough but is not discolored after light grey is printed C: A surface is severely rough and discolored It was confirmed that the blocking was inhibited in the case of the thermal transfer sheets that showed no discoloration and were rated as Grades A and B. On the other hand, it was confirmed that the blocking was not inhibited in the case of the thermal transfer sheets that showed discoloration and were rated as Grade C.

[Evaluation Results of Thermal Transfer Sheet]

The evaluation results and compositions of the thermal transfer sheets used for evaluation are listed in the following Table 1.

| | AS resin | Acrylic resin | | | | | Polyester polyol | Evaluation results | | | |
|---|---|---|---|---|---|---|---|---|---|---|---|
| | | Monomer ratio | | | | Parts by mass | | | | | |
| | Parts by mass | PEMA | MMA | nBMA | HEMA | | Parts by mass | Sensitivity | Light fastness | Spreading | Blocking |
| Example 1 | 75 | 90 | — | — | 10 | 25 | — | B | C | A | A |
| Example 2 | 50 | 90 | — | — | 10 | 50 | — | A | B | B | B |
| Example 3 | 80 | 90 | — | — | 10 | 20 | — | B | C | A | A |
| Example 4 | 90 | 90 | — | — | 10 | 10 | — | C | C | A | A |
| Example 5 | 75 | 90 | — | — | 10 | 25 | 5 | B | C | A | A |
| Example 6 | 75 | 90 | — | — | 10 | 25 | 10 | A | B | A | A |
| Example 7 | 75 | 90 | — | — | 10 | 25 | 15 | A | B | B | B |
| Example 8 | 75 | 90 | — | — | 10 | 25 | 20 | A | B | C | B |
| Example 9 | 75 | 75 | — | — | 25 | 25 | — | D | C | A | A |
| Example 10 | 75 | 80 | — | — | 20 | 25 | — | C | C | A | A |
| Example 11 | 75 | 85 | — | — | 15 | 25 | — | B | C | A | A |
| Example 12 | 75 | 95 | — | — | 5 | 25 | — | B | C | B | A |
| Comparative Example 1 | 100 | — | — | — | — | — | — | D | D | A | A |
| Comparative Example 2 | — | 90 | — | — | 10 | 100 | — | A | A | D | C |
| Comparative Example 3 | — | — | 90 | — | 10 | 100 | — | E | D | C | A |
| Comparative Example 4 | — | — | — | 90 | 10 | 100 | — | C | D | E | C |
| Comparative Example 5 | — | — | — | — | — | — | 100 | E | D | E | C |

AS resin: acrylonitrile-styrene copolymer (copolymer of acrylonitrile and styrene at mixing ratio of 24:76) AS-61 from Nippon Steel Chemical Carbon Co., Ltd.
PEMA: 2-phenoxyethyl methacrylate
MMA: methyl methacrylate
nBMA: n-butyl methacrylate
HEMA: 2-hydroxyethyl methacrylate
Polyester polyol: hexanediol-adipic acid condensation product (OH at both ends) HS2H-451A from Hokoku Oil Mill Co., Ltd.

As listed in Table 1, all the thermal transfer sheets of Examples 1 to 12 in which the dye receiving layer includes a mixture of the AS resin and the acrylic resin (a copolymer of PEMA and HEMA) showed good evaluation results on sensitivity, light fastness, spreading and blocking resistance. In particular, it was revealed that the thermal transfer sheets of Examples 5 to 8 in which the dye receiving layer included the polyester polyol showed very excellent sensitivity. Also, the sensitivity tended to be slightly reduced in the case of Example 9 in which a ratio of PEMA to HEMA as the monomer was out of a range of 80:20 to 95:5.

Meanwhile, the thermal transfer sheet of Comparative Example 1 which did not include the acrylic resin showed reduced sensitivity and light fastness. Also, at least one of the sensitivity, the light fastness, the spreading and the blocking resistance was reduced in the case of Comparative Examples 2 to 4 which did not include the AS resin. In addition, all the evaluation results were poor in the case of Comparative Example 5 which did not include either of the AS resin and the acrylic resin. Further, the evaluation result of the sensitivity was bad in the case of Comparative Example 6 in which a PEMA homopolymer was used as the acrylic resin.

Although the preferred embodiments of the present disclosure have been described in detail with reference to accompanying drawings, these embodiments are not intended to limit the technical scope of the present disclosure. It should be understood by those skilled in the art that various modifications, combinations, sub-combinations and alterations may occur depending on design requirements and other factors insofar as they are within the scope of the appended claims or the equivalents thereof.

In the above-described preferred embodiments of the present disclosure, the thermal transfer sheet 100 has a bilayer structure in which the dye receiving layer 120 is formed on the base sheet 110, but the present disclosure is not limited to this structure. For example, a base layer may be formed between the base sheet 110 and the dye receiving layer 120. To control a coefficient of friction between the thermal transfer sheet 100 and a conveyance mechanism of the recording device so that the thermal transfer sheet 100 can be stably conveyed inside the recording device operating in a thermal transfer mode, a back coating layer may also be formed on a surface opposite to a surface of the base sheet 110 in which the dye receiving layer 120 is not formed. In addition, the dye receiving layers 120 may be formed on both surfaces of the base sheet 110 so that images can be formed both surfaces of the thermal transfer sheet 100.

Additionally, the present technology may also be configured as below.

(1) A thermal transfer sheet including:

a base sheet; and a dye receiving layer formed on the base sheet and containing a mixture of copolymer A including styrene and acrylonitrile as monomers and a copolymer B including 2-phenoxyethyl methacrylate and 2-hydroxyethyl methacrylate as monomers.

(2) The thermal transfer sheet according to (1), wherein the copolymer A and the copolymer B are mixed at a mass ratio of 50:50 to 90:10.

(3) The thermal transfer sheet according to (1) or (2), wherein a molar ratio of the styrene to the acrylonitrile in the copolymer A is in a range of 70:30 to 80:20.

(4) The thermal transfer sheet according to any one of (1) to (3), wherein a molar ratio of the 2-phenoxyethyl methacrylate to the 2-hydroxyethyl methacrylate in the copolymer B is in a range of 80:20 to 95:5.

(5) The thermal transfer sheet according to any one of (1) to (4), wherein the dye receiving layer further contains a polyester polyol.

(6) The thermal transfer sheet according to (5), wherein the polyester polyol is present at a content of 5 parts by mass to 20 parts by mass, based on 100 parts by mass of the mixture of the copolymer A and the copolymer B.

The present disclosure contains subject matter related to that disclosed in Japanese Priority Patent Application JP 2011-208137 filed in the Japan Patent Office on Sep. 22, 2011, the entire content of which is hereby incorporated by reference.

What is claimed is:

1. A thermal transfer sheet comprising:

a base sheet; and a dye receiving layer formed on the base sheet and containing a mixture of copolymer A including styrene and acrylonitrile as monomers and a copolymer B including 2-phenoxyethyl methacrylate and 2-hydroxyethyl methacrylate as monomers.

2. The thermal transfer sheet according to claim 1, wherein the copolymer A and the copolymer B are mixed at a mass ratio of 50:50 to 90:10.

3. The thermal transfer sheet according to claim 1, wherein a molar ratio of the styrene to the acrylonitrile in the copolymer A is in a range of 70:30 to 80:20.

4. The thermal transfer sheet according to claim 1, wherein a molar ratio of the 2-phenoxyethyl methacrylate to the 2-hydroxyethyl methacrylate in the copolymer B is in a range of 80:20 to 95:5.

5. A thermal transfer sheet comprising:

a base sheet; and a dye receiving layer formed on the base sheet and containing a mixture of copolymer A including styrene and acrylonitrile as monomers and a copolymer B including 2-phenoxyethyl methacrylate and 2-hydroxyethyl methacrylate as monomers, wherein the dye receiving layer further contains a polyester polyol.

6. The thermal transfer sheet according to claim 5, wherein the polyester polyol is present at a content of 5 parts by mass to 20 parts by mass, based on 100 parts by mass of the mixture of the copolymer A and the copolymer B.

* * * * *